United States Patent [19]

Evans

[11] 4,154,010

[45] May 15, 1979

[54] IRONING BOARD ATTACHMENT APPARATUS

[76] Inventor: Jerry W. Evans, 365 Alexandria Dr., Macon, Ga. 31210

[21] Appl. No.: 880,625

[22] Filed: Feb. 23, 1978

[51] Int. Cl.[2] ..... D06F 81/10

[52] U.S. Cl. ..... 38/106; 248/226.4; 248/311.1 R

[58] Field of Search ..... 38/103, 104, 106, 107, 38/108, 111, 140; 223/106, 107, 108, 109 R, 109 A; 112/217.1; 312/349; 248/226.4, 311.1

[56] References Cited

U.S. PATENT DOCUMENTS

| | | | |
|---|---|---|---|
| 1,645,470 | 10/1927 | Alheit | 248/226.4 X |
| 2,234,233 | 3/1941 | Corey | 223/107 |
| 2,461,825 | 2/1949 | Kowalski | 248/226.4 X |
| 2,666,999 | 1/1954 | Brant | 38/107 |
| 2,683,640 | 7/1954 | Mangine | 248/226.4 |
| 2,754,603 | 7/1956 | Williams | 38/106 |
| 2,905,423 | 9/1959 | Smith et al. | 248/226.4 |
| 3,913,878 | 10/1975 | Wayne | 38/104 |

FOREIGN PATENT DOCUMENTS

| | | | |
|---|---|---|---|
| 552911 | 2/1958 | Canada | 38/106 |

*Primary Examiner*—Louis Rimrodt
*Attorney, Agent, or Firm*—Jones, Thomas & Askew

[57] ABSTRACT

A removable utility attachment apparatus for use with a conventional ironing board whereby said apparatus provides multiple storage compartments in which safety pins, straight pins, clothes pins, buttons, and various other ironing accessories may be stored for easy access. The apparatus also provides a hanger bar below the ironing board surface upon which clothes hangers may be hung.

6 Claims, 5 Drawing Figures

IRONING BOARD ATTACHMENT APPARATUS

The present invention relates to a removable utility apparatus for use with a conventional ironing board. The apparatus provides multiple compartments for the separate storage of various ironing paraphernalia. A hanger bar attached to the apparatus also provides a convenient place to hang clothes hangers during the ironing operation.

Over the years, a number of devices have been developed for use in conjunction with ironing boards. U.S. Pat. No. 2,288,072 discloses a cabinet arrangement integrally attached to the ironing board. A number of drawers and compartments are provided in the cabinet and a foldable clothes hamper underlies the ironing board. U.S. Pat. No. 1,871,813 discloses a clothes support bracket that is composed of a wire loop attached to the frame of the ironing board and having a fabric stretched over the wire loop. U.S. Pat. No. 2,884,722 discloses an ironing board cover with a pouch or bag attached thereto so as to provide a storage compartment for various items.

None of the above-described patents, however, disclose an easily removable apparatus having a plurality of storage compartments. Further, none of those patents disclose a bracket upon which clothes hangers may be hung.

Accordingly, it is an object of the present invention to provide an improved utility attachment for an ironing board.

It is another object of the present invention to provide a removable utility apparatus for use with an ironing board and having a plurality of separate compartments in which various ironing paraphernalia may be stored.

Another object of the present invention is to provide a removable utility apparatus for use with an ironing board in which said apparatus has a bracket upon which clothes hangers may be temporarily hung during the ironing operation.

These and other objects, features and advantages will become apparent from a review of the following detailed description of the invention and the accompanying drawing.

DETAILED DESCRIPTION OF THE DISCLOSED EMBODIMENT

Figure 1:
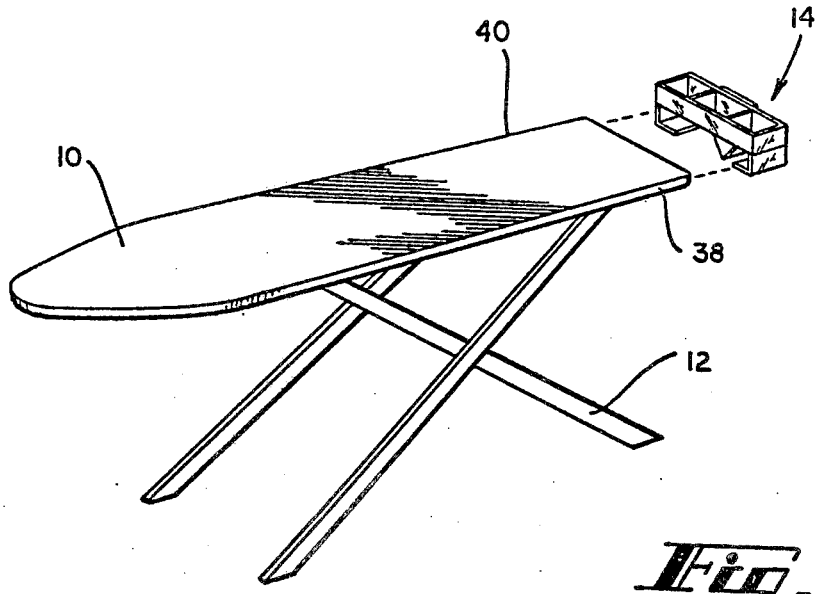
FIG. 1 is a pictorial view of apparatus according to the disclosed embodiment of the present invention as it would be used with a conventional ironing board.
Figure 2:
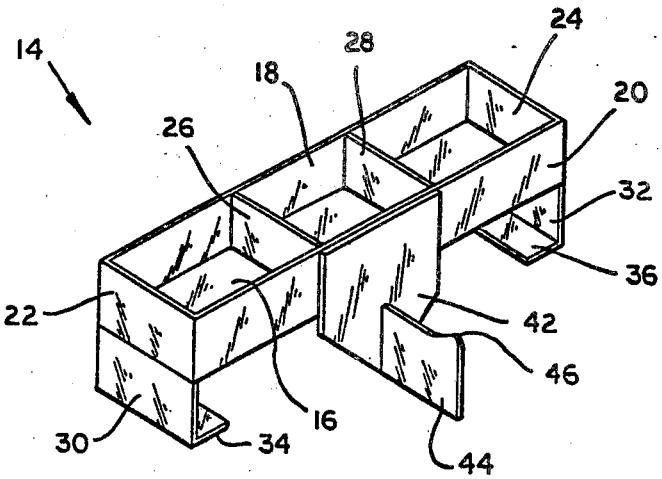
FIG. 2 is a pictorial view of the apparatus of FIG. 1.
Figure 3:
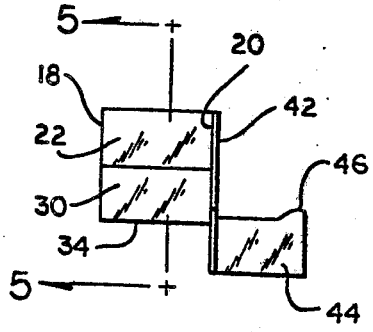
FIG. 3 is an end view of the apparatus of FIG. 1.
Figure 4:
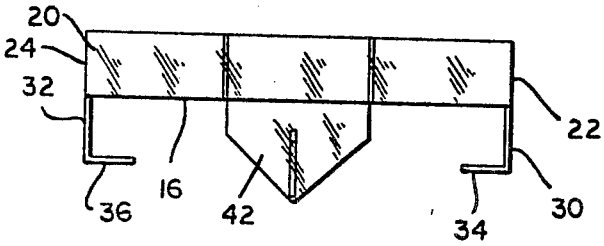
FIG. 4 is a back view of the apparatus of FIG. 1.
Figure 5:
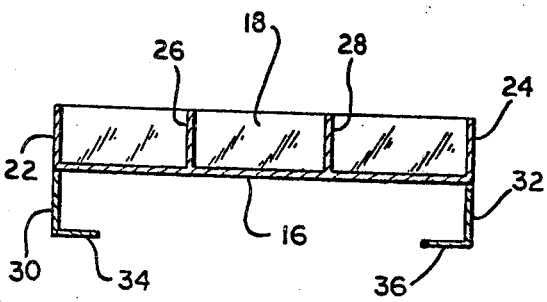
FIG. 5 is a cross-sectional view taken along the line 5—5 in FIG. 3.

Referring now to the drawing in which like numbers indicate like elements, it will be seen that there is a conventional ironing board 10 having foldable legs 12 which may be collapsed for easy storage. Attached to the ironing board 10 is the apparatus 14 according to the present invention.

The apparatus 14 comprises three separate storage compartments adjacent to each other and defined by the floor 16, the side walls 18 and 20, and the end walls 22 and 24. Each storage compartment is separated from the adjacent compartment by means of partitions such as the partitions 26 and 28. The use of two partitions in this disclosed embodiment of the invention thereby provides three separate storage compartments. However, it is within the contemplation of the present invention that any convenient number of partitions might be used to produce any desired number of storage compartments. Similarly, the overall dimensions of the walls and partitions may be varied to provide larger or smaller storage compartments.

Attached to the floor 16 at either end of the apparatus 14 are two L-shaped brackets having side members 30 and 32 and lower flanges 34 and 36. These L-shaped brackets fit over the edges 38 and 40 of the ironing board 10 with the lower flanges 34 and 36 extending below the ironing board 10. These L-shaped brackets prevent the apparatus 14 from moving up or down or back and forth with respect to the ironing board 10. Yet, while securing the apparatus 14 to the ironing board, the L-shaped brackets permit easy removal of the apparatus 14 by merely sliding the apparatus off the end of the ironing board.

Attached to the side wall 20 at the mid-point with respect to the length of the side wall is the stop bracket 42. This bracket has a dual function. When the apparatus 14 is slipped over the end of an ironing board, the stop bracket 42 prevents slipping the apparatus 14 too far onto the working surface of the ironing board. Thus, when the end edge of the ironing board contacts the stop bracket 42, the apparatus 14 is correctly positioned for use.

The other function of the stop bracket 42 is to serve as a mounting bracket for the hanger bar bracket 44 which extends outwardly from the board face of the stop bracket. A hump 46 disposed on the upper end of the hanger bar bracket 44 prevents the hangers from accidentally slipping off the end of the bracket 44. The hanger bar bracket 44 thereby provides a site for temporarily storing clothes hangers. For example, a supply of empty hangers may be hung on the hanger bar bracket 44. After the clothing is pressed, a hanger may be retrieved from the hanger bar bracket 44, the clothing hung on the hanger and the hanger returned to the bracket 44.

The apparatus 14 may be constructed out of a variety of materials any of which possess sufficient strength and rigidity to withstand the various stresses which the apparatus is likely to encounter, but it is preferred that the apparatus 14 be constructed from plastic.

It should be understood, of course, that the foregoing relates only to a preferred embodiment of the present invention and that numerous modifications or alterations may be made therein without departing from the spirit and scope of the invention as set forth in the appended claims.

What is claimed is:

1. A removable utility apparatus for selective engagement with the end of an ironing board, said apparatus comprising:

a plurality of separate compartments adjacent to and attached to each other;

a pair of L-shaped brackets attached to said apparatus, said L-shaped brackets being engageable with the edges of said ironing board, so as to support said compartments on the top surface of the ironing board; and end bracket means attached to said apparatus for providing a site for temporarily storing clothes hangers, said end bracket means extending outwardly from said compartments at a point intermediate said edges of said ironing board.

2. Removable utility apparatus as in claim 1 wherein the top surface of said ironing board forms an imaginary horizontal plane and wherein said end bracket means are disposed below said plane.

3. Removable utility apparatus as in claim 1, wherein said end bracket means includes a hanger retaining means which prevents hangers from accidentally slipping off the end of said bracket means.

4. Removable utility apparatus as in claim 3, wherein said end bracket comprises a hanger support surface which is maintained substantially horizontal when said utility apparatus is mounted on an ironing board, and said retaining means comprises means extending upwardly on said support surface to inhibit hangers from sliding off said surface.

5. A removable utility apparatus for selective engagement with the end of an ironing board, said apparatus comprising:

a front surface, a back surface, a left end surface, a right end surface, and a bottom surface intersecting one another so as to define a storage area;

partition means extending between at least selected ones of said surfaces so as to divide said storage area into a plurality of individual compartment areas;

a left L-shaped bracket extending downwardly from said left end surface and a right L-shaped bracket extending downwardly from said right end surface, said brackets being mounted in confronting mutually spaced apart relation so as to receive and engage the end of said ironing board whereby said storage area is supported on top of the ironing board at said end thereof;

stop bracket means attached to said back surface and extending downwardly therefrom to terminate below said bottom surface;

hanger bracket means extending outwardly from said stop bracket means intermediate said left end surface and said right end surface, said hanger bracket means having a hanger support surface; and hanger retaining means disposed on said hanger support surface and extending upwardly therefrom at a location which is spaced apart from said stop bracket means so as to inhibit hangers from sliding off said hanger support surface.

6. Removable utility apparatus as in claim 5, wherein the surface of said ironing board forms an imaginary horizontal plane and wherein said hanger bracket means are disposed below said plane.

* * * * *